US007908894B2

(12) United States Patent
Ronchi

(10) Patent No.: US 7,908,894 B2
(45) Date of Patent: Mar. 22, 2011

(54) DEVICE AND PROCESS FOR INDIGO DYEING

(75) Inventor: Francesco Ronchi, Sovico (IT)

(73) Assignee: Master S.r.l., Macherio-Milano (IT)

( * ) Notice: Subject to any disclaimer, the term of this patent is extended or adjusted under 35 U.S.C. 154(b) by 288 days.

(21) Appl. No.: 12/087,504

(22) PCT Filed: Jan. 11, 2007

(86) PCT No.: PCT/EP2007/000370

§ 371 (c)(1),
(2), (4) Date: Jul. 7, 2008

(87) PCT Pub. No.: WO2007/080134

PCT Pub. Date: Jul. 19, 2007

(65) Prior Publication Data

US 2009/0000042 A1 Jan. 1, 2009

(30) Foreign Application Priority Data

Jan. 13, 2006 (IT) ..... MI2006A0048

(51) Int. Cl.
*D06B 3/04* (2006.01)

(52) U.S. Cl. ..... 68/5 D; 68/5 E

(58) Field of Classification Search ..... 68/5 D, 68/5 E; 8/151

See application file for complete search history.

(56) References Cited

U.S. PATENT DOCUMENTS

| | | | | | |
|---|---|---|---|---|---|
| 2,424,857 | A | * | 7/1947 | Scull | 8/587 |
| 2,487,197 | A | * | 11/1949 | Stott et al. | 8/650 |
| 3,311,991 | A | * | 4/1967 | Gidlow | 34/292 |
| 3,415,084 | A | * | 12/1968 | Wilford et al. | 68/9 |
| 3,981,680 | A | * | 9/1976 | Fletcher | 8/502 |
| 3,988,108 | A | * | 10/1976 | Segoshi et al. | 8/532 |
| 5,174,864 | A | * | 12/1992 | Arbizzani et al. | 202/175 |
| 5,378,246 | A | * | 1/1995 | Gurley | 8/625 |
| 5,611,822 | A | * | 3/1997 | Gurley | 8/625 |
| 5,634,226 | A | * | 6/1997 | Oschatz | 8/149.1 |
| 5,922,084 | A | * | 7/1999 | Fuchs et al. | 8/149.1 |
| 6,090,157 | A | * | 7/2000 | Traut et al. | 8/149.3 |
| 6,355,073 | B1 | * | 3/2002 | Godau | 8/149.1 |
| 7,621,156 | B2 | * | 11/2009 | Kim et al. | 68/23 R |

FOREIGN PATENT DOCUMENTS

| | | | |
|---|---|---|---|
| DE | 43 42 313 | * | 6/1995 |
| DE | 197 04 147 | C | 4/1998 |
| EP | 0 361 098 | A | 4/1990 |
| EP | 1 498 534 | A | 1/2005 |
| WO | WO98/45521 | A | 10/1998 |
| WO | WO2006/013458 | | 2/2006 |

OTHER PUBLICATIONS

PCT Search Report, Dated Apr. 5, 2007.

* cited by examiner

*Primary Examiner* — Frankie L Stinson

(74) *Attorney, Agent, or Firm* — Hedman & Costigan, P.C.; James V. Costigan

(57) ABSTRACT

Device (100) and dyeing process in continuous with indigo for warp yarn chains (3) and/or fabrics, equipped with a first hermetically sealed dyeing compartment (1), suitable for containing the dye bath, and a hermetically sealed fixing/dehydration compartment (2) of the yarn (3). The two dyeing (1) and fixing/dehydration (2) compartments comprise an inert environment and are functionally and hermetically connected with each other and there are means (4) for introducing nitrogen and/or deoxygenated air inside the same compartments; inside the compartment (2) there is at least one means (5) for directly heating and/or dehydrating the yarn (3).

21 Claims, 2 Drawing Sheets

DEVICE AND PROCESS FOR INDIGO DYEING

Figure 1:
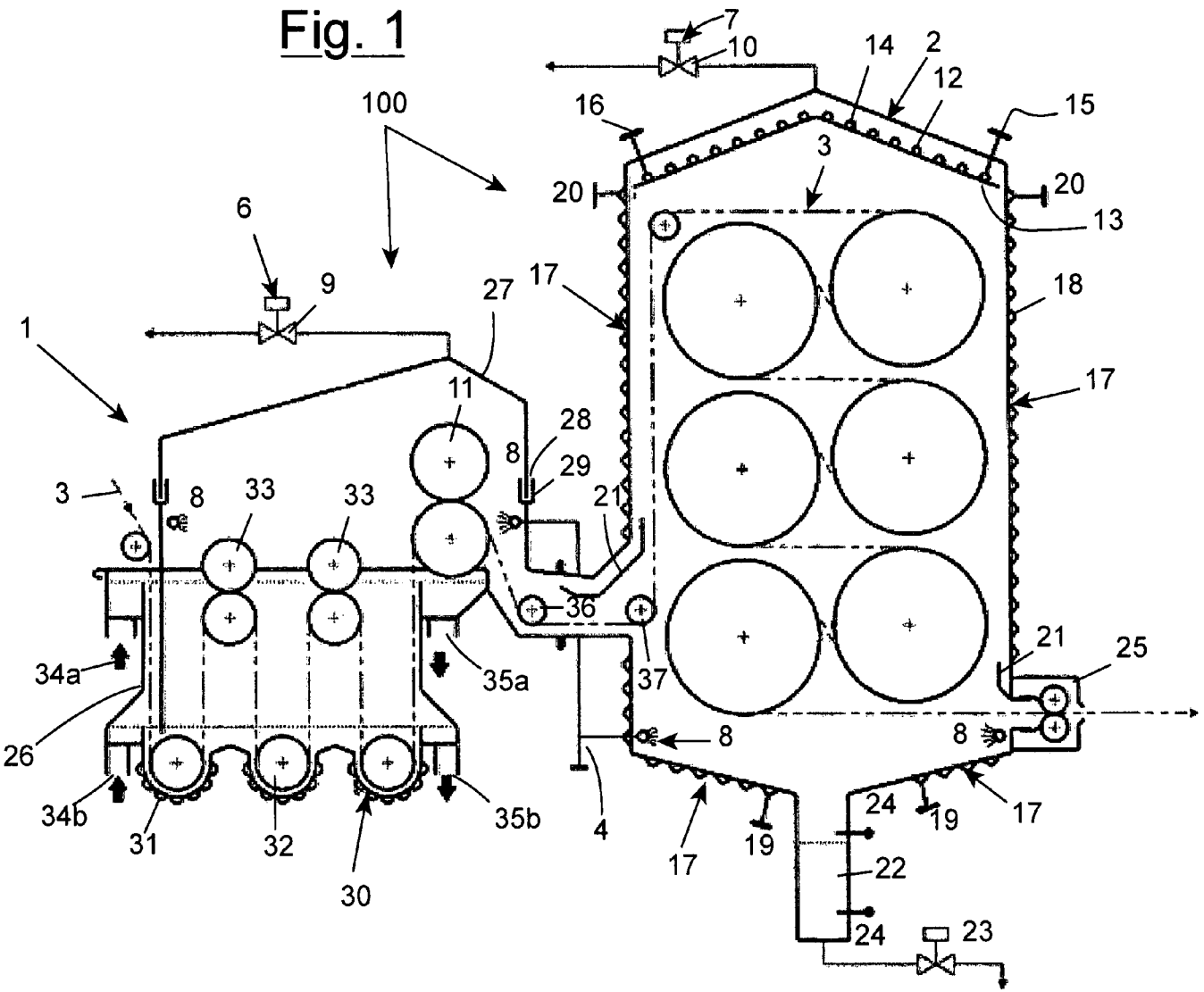

The present invention relates to a device and dyeing process with indigo to which warp yarn chains and/or fabrics are subjected in continuous.

One of the characteristics of the colour indigo, which makes it unique, is the particular dyeing method it requires for its application to cotton yarn.

It has remained practically unvaried from the times of vegetable dyes to the present day, over a hundred years from it synthesis.

In order to be applied, in fact, this dye, with a relatively small molecule and low affinity for cellulose fibres, must not only be reduced in an alkaline solution (leuco), but also requires various impregnations with alternating squeezing and subsequent air oxidations; in practice, a medium or dark colour shade is only obtained by subjecting the yarn to a first dyeing process (impregnation, squeezing, oxidation) immediately followed by several overdyeing processes, whose number depends on the darkness of the shades and degree of colour solidity requested.

For indigo, the most widely applied dyeing technology is that in continuous, of cotton warps, on multistep plants.

Each phase comprises the impregnation of the yarn with the leuco solution, at a relatively low temperature, followed, after squeezing, by a passage in air to allow the leuco to oxidize, become blue and then insoluble.

The indigo applied to the fibre must be in insoluble form before the dyed yarn is impregnated again in the leuco, to prevent a part of the dye already absorbed by the yarn from being reduced, and allow it, on the contrary, to recover with a consequent intensification of the colour shade.

This explains the importance of the construction data of the dyeing plants, whose functioning parameters must take into account the particular properties of this dye.

The continuous dyeing with indigo, of warp chains for denim fabrics, is mainly effected according to two systems: the cord system and flat system, at rates varying from 20 to 40 metres per minute.

In the cord dyeing system, which was created more or less in the Twenties' of the last century and has remained unvaried, approximately 300/400 warp threads are joined to form a cord, this cord is wound to form a ball, and 12÷36 balls are positioned at the inlet of the dyeing machine so that the relative cords can be simultaneously passed through the dyeing tanks, they are then dried and stratified in large pots.

The cords are subsequently opened and beamed and the beams, in such a quantity as to form a warp chain, are passed into the sizing machine thus forming weaving beams; all in all, it is therefore a not continuous system.

The flat system, on the other hand, created in the Seventies' of the last century, is on the whole totally a continuous system as it contemporaneously effects both the dyeing and sizing.

Approximately 250/400 warp threads are in fact beamed forming a warp fraction, 10÷16 of these beams are positioned at the inlet of the dyeing machine so as to form the whole warp chain, which is passed through the dyeing tanks and then directly into the sizing machine connected therewith on line; in practice, at the beginning there are fractional beams, obtaining, after dyeing and sizing in continuous, weaving beams.

Although the two systems described above are substantially different, when dyeing with indigo however they are linked by the use of the same dyeing method essentially consisting, as already specified, by three operating phases which are repeated several times: impregnation of the yarn with the dye in reduction, squeezing to eliminate the excess wetting and oxidation of the dye by exposure to the air of the dyed yarn.

This particular dyeing method, which is typical of indigo dyes, demonstrates the considerable importance of respecting certain basic parameters relating to the immersion and oxidation times, to allow the dye to impregnate and be uniformly distributed in the cortical layer of the yarn (ring dyeing) and, after perfect squeezing, to be completely oxidized, before entering the subsequent tank in order to recover, i.e. intensify the colour shade.

Unfortunately, dyeing in continuous with indigo is not only influenced by these parameters but also by numerous other factors relating to the different physico-chemical contexts of each single plant, as well as the environmental conditions where this is installed, such as temperature and relative humidity of the air, wind conditions, height, etc.

Furthermore, the different dyeing conditions, such as: number of tanks, their capacity and metres immersed, squeezing pressure, pick-up, type and rate of bath circulation, type and accuracy of the automatic dosing systems of the indigo, sodium hydrosulfite and caustic soda, etc., and the various conditions of the dye bath, such as: temperature, concentration, pH, Redox potential, etc., not only decisively influence the dyeing results such as the greater or lesser dye intensity, the solidity, the corticality, etc. but also considerably contribute to determining the final appearance of the clothes produced after the washing and enhancing treatment to which they are normally subjected.

It should be pointed out that, contrary to other dye groups, for which the affinity for cotton increases with an increase in the temperature, for indigo the affinity and colour intensity, due to a greater corticality of the dyeing, increases with a decrease in the temperature.

More specifically, machines for continuous dyeing with indigo normally consist of 2÷4 pretreatment tanks, 6÷10 dyeing tanks and 2÷4 final washing tanks, all equipped with a squeezing group to eliminate the excess wetness, and the dyeing tanks also equipped with groups of cylinders, in air, for oxidation.

The dyeing tanks are of the open type, each has a bath capacity of about 3000/3500 liters and a content of about 8÷11 metres of yarn in the cord system, whereas the capacity varies from 800 to 1500 liters with a content of about 4÷6 metres of yarn in the flat system; these bath quantities determine the total bath volume in circulation which can reach about 30.000 liters and 15.000 liters, respectively.

The bath contained in each tank is continuously recycled to guarantee the concentration homogeneity in each tank; this circulation is normally effected by means of various known piping systems with centrifugal pumps with a high flow-rate and low prevalence to avoid harmful turbulences.

Unfortunately, in spite of all the relative precautions, this movement of the bath causes the continuous exchange of its surface, which is in contact with the air, as the tanks are open above, thus causing oxidation with a consequent impoverishment of the reducing agents contained therein, i.e. sodium hydrosulfite and caustic soda, and this to an ever greater extent as the temperature of the bath increases.

There are however numerous oxidation phases, which are an integral part of the dyeing cycle and which in practice consist in exposure to the air of about 30÷40 metres of yarn impregnated with leuco, from one tank to another of the 6÷10 dyeing tanks, and therefore for a total of various hundreds of metres, which contribute to a much greater extent than what is indicated above to impoverishing the same elements of the dye bath with which the yarn itself is impregnated.

This leads to the necessity of continuously reintegrating the dye bath with the quantities of sodium hydrosulfite and caustic soda destroyed by the above oxidations, in order to keep it constantly under optimum chemical conditions for the best dyeing yield and guaranteeing constant and repeatable results; these continuous conditions imply a significant economic cost, they increase the salinity of the bath with consequent dyeing problems and also create considerable pollution of the final washing water.

Dye must naturally also be continuously and constantly added to the dye bath, under a condition of concentrated leuco, in the necessary quantity for obtaining the desired colour shade.

Numerous systems can be used for the automatic dosing in continuous of the indigo dye, sodium hydrosulfite and soda, such as dosage pumps, weighing, volumetric, mass systems, etc., all known however as they are normally also used in other textile processing, etc.

The higher the volume, obviously the greater time it will take to bring a new bath to chemical/dyeing equilibrium necessary for constantly obtaining the same colour shade and the response time for possible corrective interventions will be equally lengthy and this does not favour the quality of the product.

Dye baths with indigo, however, and this is another particular characteristic of this dye, are never substituted, except for changing the colour shade, but, as already stated, they are continuously reused with the addition of sodium hydrosulfite, caustic soda and dye in order to keep their chemical/dyeing equilibrium constant.

Every dyeing plant therefore has a certain number, corresponding to the blue variations being produced, of containers with the total capacity of all the dyeing tanks, for the storage and reuse of these baths.

For qualitative purposes, it is of the utmost importance to keep the physico-chemical conditions of the dyeing bath constant for the whole time necessary for the dyeing of the whole batch, said time normally oscillating between 15 and 36 hours depending on the length of the yarn and dyeing rate.

Unfortunately, in spite of the continuous mechanical and hydraulic perfectioning of dyeing machines and the help of sophisticated control and dosing systems, as a result of the large volumes in question, and also for the numerous reasons specified above, which, either individually or associated with each other, can contribute to creating undesired variations in the dye bath conditions, continuous dyeing with indigo remains a difficult operation, where very often the solving or non-solving of a problem or obtaining a good quality are also linked to the skill and experience of the operator.

This is also complicated by the fact, which is extremely important in the flat dyeing system, of the drawing-in yarn length of the dyeing/sizing line, which, in the most complete and multifunctional machines, can even reach about 500/600 metres, which not only makes it difficult to control the whole unit, but also creates waste and therefore a loss of money with the changing of each batch.

These problems are of even greater importance today than in the past, as denim, which has taken over fashion, needs great flexibility with continuous requirements for diversification of the colour shades, penetration and solidity with washing, etc., and in increasingly shorter batches.

In the light of what is specified above, there is the evident necessity of availing of a dyeing device which allows numerous dyeing processes with a drastic reduction in the consumption of hydrosulfite and soda, and consequently also a reduction in the salinity of the dye bath.

An objective of the present invention is therefore to provide a dyeing device which allows multiple dyeing processes with a drastic reduction in the consumption of hydrosulfite and soda, and consequently also a reduction in the salinity of the dye bath.

A further objective of the present invention is to significantly reduce the number of dye tanks and consequently the dimensions and cost of the machine, to reduce the capacities of the recovery tanks, allow the dyeing equilibrium to be rapidly reached and optimize the dye processes, making these processes independent of all external variables.

Another objective of the present invention is to provide a dyeing device which makes it possible to operate so as to reduce the length of the yarn in the passages in air for oxidation and consequently reduce waste at each batch change.

Yet another objective of the present invention is to provide a device which, in indigo dyeing, increases the diffusion and fixing of the dye in the fibre and also increases the absorption capacity (pick-up) of the dye itself.

A further objective of the present invention is to provide a device which, in indigo dyeing, allows much higher colour and solidity performances to be obtained with respect to those of the known art, with a consequent saving of dye and less pollution of the washing water.

These and other objectives are achieved with the dyeing device in continuous with indigo for yarn chains according to the present invention, which has the characteristics of the enclosed claims.

Figure 2:
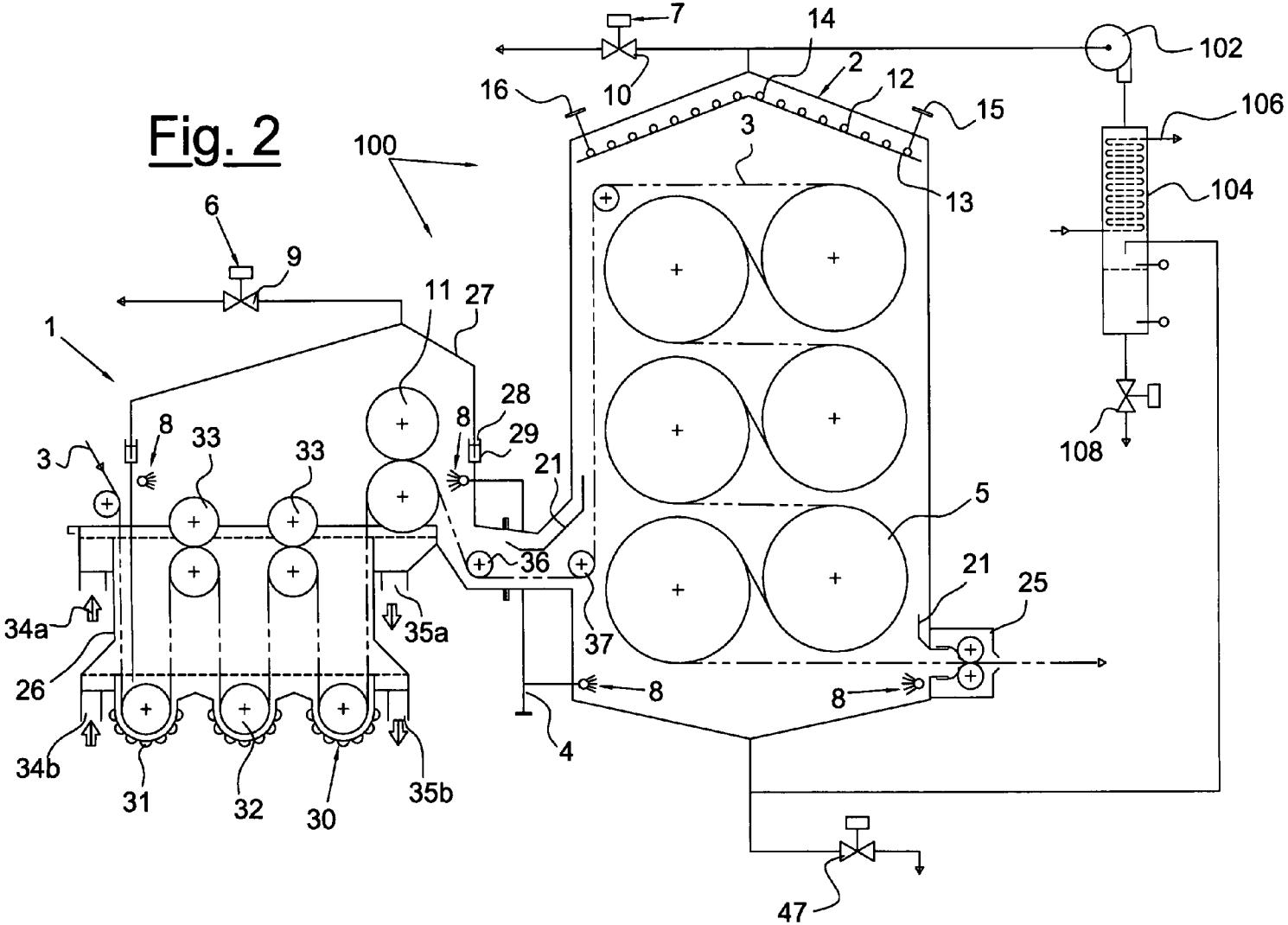

Further characteristics and advantages of the present invention will appear more evident following the present description, provided for illustrative and non-limiting purposes, with reference to the enclosed drawings, in which:

FIG. 1 shows a raised side view of a first embodiment of the dyeing device according to the present invention; and FIG. 2 shows a raised side view of a second embodiment of the dyeing device according to the present invention.

With reference to the figures, these show a yarn dyeing device in continuous with indigo according to the present invention.

For the sake of clarity, reference will be made hereafter to warp yarn chains alone, even if the description obviously also refers to fabrics.

As can be seen in FIG. 1, the dyeing device, marked as a whole with the reference number 100, comprises a dyeing compartment in an inert environment 1, hermetically sealed, suitable for containing the dye bath, and at least one fixing/dehydration compartment 2, in an inert environment, of the yarn 3.

The fixing/dehydration compartment 2 in an inert and hermetically sealed environment, is functionally and hermetically connected to the dyeing compartment 1.

In the compartments 1 and 2 there are means 4 for introducing nitrogen and/or deoxygenated air inside the same compartments, to make them inert; in the compartment 2 there is at least one means 5 for directly heating and/or dehydrating, again directly, the yarn 3.

The direct heating of the yarn 3, in an inert environment, increases the diffusion and fixing of the dye in the fibre after impregnation in the dyeing compartment 1, whereas the consequent dehydration by evaporation of the water contained allows a greater absorption of the dye in the subsequent phases.

The inert environment allows a reduction in the consumption of hydrosulfite and soda used in the dye bath with indigo at both high and low temperatures and allows the heating and dehydration of the yarn without oxidation of the dye contained therein.

The inert environment and direct heating of the yarn also make it possible to operate with dye baths having a high concentration of indigo, at a low level and high temperature, new processes which, combined with the known processes, allow numerous different dyeing results to be obtained.

For making the dyeing compartment 1 and fixing/dehydration compartment 2 inert, in addition to the means 4 for the continuous introduction of nitrogen and/or deoxygenated air, the compartments themselves are respectively equipped with means 6 and 7 for the initial expulsion of the air contained therein.

The means 4 for the introduction of nitrogen and/or deoxygenated air inside the compartments 1 and 2 comprise at least one inlet nozzle 8 connected to a source, not shown, of deoxygenated air or nitrogen under pressure.

The means 6 and 7 for the expulsion of air, on the other hand, comprise at least one discharge valve 9 and 10, respectively.

An initial flushing of nitrogen or deoxygenated air for a certain time, with the valves 9 and 10 open, allows the air to be discharged from the compartments 1 and 2, as a result of the overpressure and different specific weight.

The flushing time necessary for creating an inert environment inside the compartments 1 and 2, is determined with the instrumental detection of the internal conditions of the compartments themselves or, alternatively, decided a priori on the evaluations and calculations of experts.

The device 100 also comprises a squeezing element 11, situated upstream of the fixing/dehydration compartment in an inert environment 2.

According to the present invention, the means for directly heating and/or dehydrating the yarn 3 are advantageously represented, in the preferential embodiment shown in FIG. 1, by heated cylinders 5, preferably heated by a fluid.

More specifically, six heated cylinders 5 are indicated, on which the yarn 3 runs, positioned in the fixing/dehydration compartment 2.

The last two cylinders 5, in relation to the particular dyeing process, can also be cooled.

Infrared sources, suitable for directly heating the yarn 3 by irradiation, or microwave sources or radiofrequencies suitable for directly heating the yarn 3, can be used alternatively as direct heating means 5 of the yarn 3.

It should be pointed out, however, that any appropriate heating means for directly heating the yarn 3 can be used, all included in the protection scope of the present invention.

The inert compartment 2 also comprises indirect heating means 12.

The indirect heating means 12 comprise an anti-condensate tile 13 with sloping brims and a coil 14 in which warm fluid circulates.

According to the embodiment shown in FIG. 1, the warm fluid is vapour and consequently a vapour inlet connection 15 situated at one end of the coil 14, is envisaged together with an outlet for the condensate 16, situated at the opposite end of the coil 14; this heating can also be effected with other means.

The double-brimmed anti-condensate tile 13 prevents the condensate from dripping on the underlying yarn 3.

The inert fixing/dehydration compartment 2 also comprises on the said walls and bottom, cooling means 17 of the walls to condense the water which evaporates from the yarn 3 following the passage on the direct heating means 5.

In the embodiment example illustrated in FIG. 1, the cooling means 17 comprise two coils 18 through which a cold fluid flows, two inlets for the cold fluid 19 and two outlets 20 for the fluid which, at the end of the coils, has become heated.

Floodgates 21 are also present for the lateral conveyance of the condensate, which serve to direct the condensate to avoid dripping on the yarn 3.

For this purpose, on the bottom of the compartment 2 there is also a collection point of the condensate 22 connected to a discharge valve 23 driven by specific control means 24, such as max-min level probes of the condensate.

According to another embodiment example, shown in FIG. 2, there are at least vapour suction means 102, such as a centrifugal aspirator, situated outside the inert fixing/dehydration compartment 2 and suitable for sucking the fluid with vapour from said compartment 2, and at least one heat exchanger 104 for condensing the water vapour coming from the compartment 2 and returning the dehumidified fluid to the same compartment 2.

In a known way, the heat exchanger 104 comprises a coil 106 through which a cooling fluid runs, and a discharge valve 108 for the water which condenses in correspondence with the bottom of the heat exchanger 104.

The fixing/dehydration compartment 2 also comprises a sealing group 25 situated downstream of the direct heating cylinders 5.

The sealing group 25 allows the yarn 3 to leave the compartment 2, preventing the discharge of nitrogen or deoxygenated air contained therein.

Said sealing group 25 can be produced in various known ways in addition to that illustrated in FIG. 1, consisting of two opposite rubberized cylinders with relative washers.

The dyeing compartment 1, on the other hand, comprises at least one tank 26 and at least one liftable and reclosable hood 27 with respect to the tank 26 to favour cleaning and maintenance interventions.

The dyeing compartment 1 is hermetically closed thanks to specific sealing means 28.

In particular, in the preferred embodiment, shown in FIG. 1, the sealing means 28 are represented by perimetric seats 29 suitable for being engaged with the hood 27 to create a hydraulic airtight seal.

Alternatively, washers, not shown, interposed between the hood 27 and the tank 26, can be envisaged as airtight sealing means 28, also included in the protection scope of the present invention.

Upstream of the means 5 for directly heating the yarn 3, inside the dyeing compartment 1, as previously specified, there is a squeezing element 11 capable of exerting a strong pressure on the yarn 3.

Strong squeezing, exerted by the element 11 on the yarn 3 leaving the dyeing compartment 1, allows the excess wetting to be eliminated from the yarn 3.

The dyeing compartment 1 is also equipped, as can be seen in FIG. 1, with at least one device 30 for the heating or cooling, indirect and without contact, of the dyeing bath.

In particular, for this purpose, the compartment 1 has at least one coil 31 in which a heating or cooling fluid circulates, suitable for heating or cooling, depending on the dyeing treatment, indirectly and without contact, the dye bath contained in the compartment 1.

For this purpose, the coils 31 form, in a known way, an interspace close to the bottom of the compartment 1.

According to the present invention, there are also advantageously immersion rolls 32 situated close to the bottom of compartment 1, which force the yarn 3 to pass into the dye bath, close to the bottom of the compartment 1.

Intermediate squeezing elements 33 are interposed between the immersion rolls 32 of the dyeing compartment 1.

The pressure exerted by the intermediate squeezing elements 33, lower than that of the element 11, favours the penetration and distribution uniformity of the dye in the yarn 3.

The compartment 1 advantageously has inlets 34*a*, 34*b* and outlets 35*a*, 35*b* of the overflow type, equipped with interception valves (not shown).

Thanks to the above inlets and outlets, by selecting the relative valves, the dyeing compartment 1 can operate with different bath levels in relation to the dyeing process to be effected.

The possibility of the compartment 1 of always operating with the maximum yarn content and with the minimum possible bath is also achieved thanks to the particular shaping, enveloping the rolls 32, of the bottom of the compartment 1.

The connection area between compartment 1 and compartment 2 can be produced with hermetic sealing, as illustrated in FIG. 1, where guide rolls 36 and 37 are present, suitable for defining the course of the yarn 3, or by applying sealing devices at the outlet of compartment 1 and at the inlet of compartment 2.

The device 100 according to the present invention, allows the yarn to be dyed, as mentioned above, with indigo with a process consisting of the following phases:

a) immersing the yarn 3 in compartment 1 containing the dye bath with indigo;

b) exerting a squeezing on the yarn 3 at the outlet of the bath of compartment 1 with a strong pressure;

c) directly heating the yarn 3 in compartment 2 to increase the diffusion and fixing of the dye in the fibre and to dehydrate it so as to increase the absorption of the dye in the subsequent phases;

d) subjecting the yarn, in a known way, to oxidation outside the device 100.

The dyeing process mentioned above has the particular characteristic of being substantially effected in an inert environment.

In particular, phases a) to c) are carried out in an inert environment, i.e. without the dye bath and yarn, impregnated with the reduced bath dye (leuco), entering into contact with the oxygen of the air, thus avoiding their oxidation which causes the considerable destruction of hydrosulfite and soda.

It should also be noted that, before beginning the dyeing process with indigo, a flow of nitrogen or deoxygenated air is introduced into compartments 1 and 2, by means of the nozzles 8, for a necessary time, which expels the air contained therein, through the means 6 and 7, thus creating a substantially inert environment.

The inert environment, thus generated, is maintained as such thanks to the hermetic sealing of the device 100 and a continuous flow through the nozzles 8.

According to the present procedure, the indigo dye bath contained in compartment 1 can be advantageously heated by favouring its penetration into the yarn, or it can be suitably cooled to increase the corticality of the dye and its affinity towards the fibre, with a consequent increase in the intensity of the colour, which, as is known, increases with a decrease in the temperature.

It should also be noted that, in order to facilitate the penetration and distribution uniformity of the dye on the yarn in the bath in the compartment 1, the yarn 3 is subjected in correspondence with said bath, to a slight squeezing with the elements 33.

The device 100 according to the present invention can be inserted into any traditional indigo dyeing plant; various devices 100 can also be envisaged in the same dyeing plant.

Furthermore, the device 100 according to the invention can also comprise means (not shown) for reintroducing the yarn 3 leaving the inert fixing/dehydration compartment 2 inside the dyeing compartment 1. In this way, a continuous cycle dyeing process is effected (loop) which reduces the number of devices 100 to be positioned in series in the same plant.

The device 100 and the processes according to the invention thus achieve the objectives mentioned in the preamble of the description and, unlike the machines and processes so far used in indigo dyeing processes, they allow a considerable reduction in the number of treatment tanks and consequently plant costs, as well as production scraps during the batch change.

The device 100 and the processes effected therewith, according to the present invention, also advantageously make it possible, in the case of indigo dyeing, to operate in an inert environment, allowing the yarn to be dehydrated without oxidation of the dye and significantly reducing the normal consumption of hydrosulfite and soda.

Thanks to the direct heating means 5 according to the present invention, the heating and/or dehydration of the yarn, in an inert environment, increases the diffusion and fixing of the dye in the yarn and the pick-up (dye absorption capacity) of the yarn itself, thus making the dyeing process more effective, economical and ecological.

The present invention is described for illustrative but non-limiting purposes, according to its preferred embodiments, but variations and/or modifications can obviously be applied by experts in the field, all included in the protection scope, as defined by the enclosed claims.

The invention claimed is:

1. A dyeing device (100) in continuous with indigo for warp yarn chains (3) and/or fabrics, equipped with a first hermetically sealed dyeing compartment (1), suitable for containing the dye bath and at least one squeezing element (11) capable of exerting a strong pressure on the yarn chain (3), and a second hermetically sealed fixing/dehydration compartment (2) of said yarn (3), wherein said first (1) and second (2) compartments comprise an inert environment and are functionally and hermetically connected with each other wherein in said first (1) and second (2) compartments, there are means (4) for introducing nitrogen and/or deoxygenated air inside the first (1) and second (2) compartments wherein said second compartment (2) is provide with at least one means for directly heating and/or dehydrating the yarn (3) consisting of a plurality of heatable cylinders (5) on which the yarn (3) passes, to increase the diffusion and fixing of the dye in the yarn (3) and to dehydrate said yarn (3) so as to increase the absorption of the dye in the subsequent yarn (3) processing phases, and wherein at least one of said cylinders (5) can also be cooled.

2. The device (100) according to claim 1, further comprising, downstream of said squeezing element (11), means for directly heating and/or dehydrating the yarn (3) consisting of at least one infrared source suitable for heating said yarn (3) by direct irradiation.

3. The device (100) according to claim 1, further comprising, downstream of said squeezing element (11), means for directly heating and/or dehydrating the yarn (3) consisting of at least one microwave or radiofrequency source suitable for directly heating the yarn (3) downstream of said squeezing element (11).

4. The device according to claim 1, further comprising, downstream of said squeezing element (11), means for directly heating and/or dehydrating the yarn (3) at least one source for at least a flow of warm fluid suitable for heating the yarn (3) by convection.

5. The device (100) according to claim 1, characterized in that said means (4) for the introduction of deoxygenated air/nitrogen inside said first (1) and second (2) compartments comprise at least one inlet nozzle (8) connected to a deoxygenated air or nitrogen source under pressure.

6. The device (100) according to claim 5, characterized in that said indirect heating means (12) comprise a tile (13) with sloping brims and a coil (14) in which hot fluid circulates.

7. The device (100) according to claim 1, characterized in that it comprises means (6) and (7) for the expulsion of the air from compartments 1 and 2 equipped with at least one discharge valve (9) and (10).

8. The device (100) according to claim 1, characterized in that said fixing/dehydration compartment (2) comprises at least one indirect heating means (12).

9. The device according to claim 8, characterized in that said fixing/dehydration compartment (2) comprises at least one condensate collection point (22) comprising at least one discharge valve (23) driven by specific control means (24).

10. The device (100) according to claim 9, characterized in that said device (30) for the heating or cooling of the bath forms an interspace close to the bottom of said compartment (1) and comprises at least one coil (31) in which a heating or cooling fluid circulates.

11. The device (100) according to claim 1, characterized in that said inert environment fixing/dehydration compartment (2) also comprises, on the side walls and on the bottom, cooling means (17) of the walls to condense the water which evaporates from said yarn (3) following the passage on said direct heating means (5).

12. The device (100) according to claim 1, characterized in that said inert environment fixing/dehydration compartment (2) also comprises at least one suction means (102) suitable for sucking the nitrogen mixed with vapour from said inert environment fixing/dehydration compartment (2) and at least one heat exchanger (104) suitable for condensing the water vapour and returning dehumidified nitrogen to said inert fixing/dehydration compartment (2).

13. The device (100) according to claim 1, characterized in that said dyeing compartment (1) comprises, on the bottom, at least one device (30) for the heating or cooling, indirect and without contact, of the dye bath contained in said compartment (1).

14. The device (100) according to claim 13, characterized in that said hermetically sealed dyeing compartment (1) comprises airtight sealing means (28).

15. The device (100) according to claim 1, characterized in that said hermetically sealed compartment (1) comprises at least one tank (26) and at least one hood (27) which is liftable with respect to said tank (26) for cleaning and maintenance interventions and hermetically reclosable on said tank (26).

16. The device (100) according to claim 1, characterized in that said dyeing compartment (1) comprises at least an intermediate squeezing group (33) suitable for exerting a squeezing on said yarn (3).

17. The device (100) according to claim 1, characterized in that it comprises a series of guide rolls (36, 37) of the yarn (3) placed in the hermetically sealed connection area between said dyeing compartment (1) and said fixing/dehydration compartment (2).

18. The device (100) according to claim 1, characterized in that said dyeing compartment (1) comprises at least one inlet (34*a*, 34*b*) and at least one outlet (35*a*, 35*b*) of the overflow type.

19. The device (100) according to claim 1, characterized in that said dyeing compartment (1) can operate with different bath levels.

20. A continuous dyeing process with indigo for yarn chains (3) with the device (100) according to claim 1, characterized in that it comprises the following phases:

a) introducing a flow of nitrogen and/or deoxygenated air into said first dyeing compartment (1) and said fixing/dehydration compartment (2) for a time sufficient for obtaining an inert environment inside said compartments (1, 2);

b) immersing the yarn (3) in said compartment (1) containing the dye bath;

c) exerting a squeezing on said yarn (3) at the outlet of the bath of said compartment (1);

d) directly heating the yarn (3) in the compartment (2) to increase the diffusion and fixing of the dye in the fibre and to dehydrate it so as to increase the absorption of the dye in the subsequent phases; and e) subjecting the yarn oxidation outside the device (100).

21. A dyeing plant characterized in that it comprises at least one dyeing device (100) according to claim 1.

* * * * *